US012253325B2

(12) United States Patent
Phillips et al.

(10) Patent No.: US 12,253,325 B2
(45) Date of Patent: Mar. 18, 2025

(54) FIREARM MAGAZINE LOADING SYSTEM

(71) Applicant: GUN-NUTZ, Midlothian, VA (US)

(72) Inventors: Donovan Phillips, Midlothian, VA (US); Leopold Dag Dag Cruz, Midlothian, VA (US); Nickolas Corbin, South Chesterfield, VA (US)

(73) Assignee: GUN-NUTZ, Midlothian, VA (US)

( * ) Notice: Subject to any disclaimer, the term of this patent is extended or adjusted under 35 U.S.C. 154(b) by 129 days.

(21) Appl. No.: 18/161,397

(22) Filed: Jan. 30, 2023

(65) Prior Publication Data

US 2024/0255246 A1 Aug. 1, 2024

(51) Int. Cl.
*F41A 9/83* (2006.01)
*F41A 9/38* (2006.01)

(52) U.S. Cl.
CPC . *F41A 9/38* (2013.01); *F41A 9/83* (2013.01)

(58) Field of Classification Search
CPC ..... F41A 9/82; F41A 9/83
See application file for complete search history.

(56) References Cited

U.S. PATENT DOCUMENTS 247,419 A * 9/1881 Sanford ..... F41A 9/83 86/47
4,304,062 A * 12/1981 Pepe ..... F41A 9/83 42/87
7,059,077 B2 * 6/2006 Tal ..... F41A 9/83 42/88
10,060,692 B2 * 8/2018 Couie ..... F41A 9/67
10,151,547 B1 * 12/2018 Plate ..... F41A 9/83
10,415,911 B2 * 9/2019 Couie ..... F41A 9/67
D888,183 S * 6/2020 Griswold ..... D22/108
11,187,480 B1 * 11/2021 Anderson ..... F41A 9/83
(Continued)

FOREIGN PATENT DOCUMENTS

GB 2484328 A * 4/2012 ..... F41A 9/82

OTHER PUBLICATIONS

Design U.S. Appl. No. 29/814,222, filed Nov. 24, 2021 with Electronic Acknowledgement Receipt (15 pages).

*Primary Examiner* — Gabriel J. Klein
(74) *Attorney, Agent, or Firm* — Nixon & Vanderhye P.C.

(57) ABSTRACT

An ammunition loading tray is configured to hold one or more ammunition cartridges in a loading position. The ammunition loading tray includes one or more loading compartments; and each loading compartment is configured to hold a corresponding one of the one or more ammunition cartridges in a loading position. Each loading compartment includes a magazine receiving portion configured to support an ammunition magazine from below and allow for less lateral movement of the ammunition magazine in a first direction than lateral movement of the ammunition magazine in a second direction that is perpendicular to the first direction. An ammunition cartridge receiving portion is located within the magazine receiving portion. The ammunition cartridge receiving portion is configured to support the ammunition cartridge from below and limit lateral movement of the ammunition cartridge in the first direction while allowing lateral movement of the ammunition cartridge in the second direction. A perimeter of the magazine receiving portion is larger than a perimeter of the ammunition cartridge receiving portion.

27 Claims, 19 Drawing Sheets

(56) References Cited

U.S. PATENT DOCUMENTS

| | | | | |
|---|---|---|---|---|
| 12,044,500 | B2 * | 7/2024 | Poston | F41A 9/83 |
| 2003/0093936 | A1 * | 5/2003 | Pikula | F41A 9/83 42/87 |
| 2017/0176121 | A1 * | 6/2017 | Plate | F41A 9/83 |
| 2018/0080729 | A1 * | 3/2018 | Couie | F41A 9/83 |
| 2018/0202735 | A1 * | 7/2018 | Draper | F41A 9/82 |
| 2018/0363999 | A1 * | 12/2018 | Couie | F41A 9/67 |
| 2022/0268542 | A1 * | 8/2022 | Poston | F41A 9/83 |
| 2022/0404110 | A1 * | 12/2022 | Baker | F41A 9/83 |

* cited by examiner

FIREARM MAGAZINE LOADING SYSTEM

FIELD OF INVENTION

The invention relates to firearms, and particularly to a method and system for loading a magazine for a firearm.

BACKGROUND

Many firearms utilize magazines to feed ammunition into the barrel chamber of the firearm. Magazines are designed to hold a plurality of ammunition rounds so that the firearm can be discharged multiple times without having to reload the firearm.

Magazines are loaded with ammunition by manually inserting each round of ammunition into the magazine, one at a time, or inserting a clip of ammunition into the magazine. However, this method can be cumbersome and time consuming.

In particular, a conventional magazine utilizes a spring to load each round of ammunition into the barrel chamber. When each round of ammunition is loaded into the magazine, the round is pressed against the spring. For each additional round of ammunition, the spring becomes more compressed and more resistant to receiving the round of ammunition. Thus, loading a magazine requires increasing effort as more rounds or clips are inserted into the magazine. This may lead to the rounds not being properly loaded into the magazine or the user not being able to load ammunition into the magazine without the help from a tool that is specialized for that particular magazine.

SUMMARY

The present technology is directed to making the loading process for a firearm magazine easier, faster, and less cumbersome for a user.

A first aspect of the technology relates to a system for loading ammunition into a firearm magazine.

Another aspect of the technology relates to a method for loading ammunition into a firearm magazine.

In another aspect of the technology, an ammunition loading tray is configured to hold one or more ammunition cartridges in a loading position. The ammunition loading tray includes one or more loading compartments. Each loading compartment is configured to hold a corresponding one of the one or more ammunition cartridges in a loading position and includes a magazine receiving portion configured to support an ammunition magazine from below and allow for less lateral movement of the ammunition magazine in a first direction than lateral movement of the ammunition magazine in a second direction that is perpendicular to the first direction. An ammunition cartridge receiving portion is located within the magazine receiving portion. The ammunition cartridge receiving portion is configured to support the ammunition cartridge from below and limit lateral movement of the ammunition cartridge in the first direction while allowing lateral movement of the ammunition cartridge in the second direction. A perimeter of the magazine receiving portion is larger than a perimeter of the ammunition cartridge receiving portion.

At least one of the one or more loading compartments may include a forward stop configured to limit forward movement of the ammunition magazine and the ammunition cartridge in the second direction. The forward stop may be in the form of a wall. At least one of the one or more loading compartments may include a pair of opposing side walls extending from a front side of the loading compartment and/or a rear side of the loading compartment that is opposite the front side. At least one of the one or more loading compartments may include a rear wall opposite a front side of the loading compartment. The rear wall may be inclined in a rearward direction. Each of the one or more loading compartments may be sized to receive ammunition cartridges of different sizes.

The ammunition loading tray may include one or more storage compartments. The one or more storage compartments may be configured to hold one or more ammunition cartridges and/or a firearm magazine. The ammunition cartridge receiving portion may be a recess in a floor of the magazine receiving portion. A length of the ammunition cartridge in the second direction may be greater than or equal to a length of the magazine receiving portion in the second direction.

The magazine receiving portion may include a floor that is sloped. The floor of the magazine receiving portion may be sloped toward or away from the ammunition cartridge receiving portion. The ammunition cartridge receiving portion may include a floor that is sloped toward a central portion of the ammunition cartridge receiving portion. A width of the ammunition cartridge receiving portion in the first direction may be less than a length of the ammunition cartridge receiving portion in the second direction. A width of the magazine receiving portion in the first direction may be less than a length of the ammunition magazine receiving portion in the second direction.

In yet another aspect of the technology, an ammunition loading tray is configured to hold one or more ammunition cartridges in a loading position. The ammunition loading tray includes one or more loading compartments. Each loading compartment is configured to hold an ammunition cartridge in a loading position and includes a supporting surface configured to support an ammunition magazine from below. The supporting surface is further configured to allow for less lateral movement of the ammunition magazine in a first direction while allowing lateral movement of the ammunition magazine in a second direction that is perpendicular to the first direction. A recess is located in the supporting surface and is configured to support the ammunition cartridge from below and limit lateral movement of the ammunition cartridge in the first direction while allowing lateral movement of the ammunition cartridge in the second direction.

In yet another aspect of the technology, an ammunition loading tray is configured to hold one or more ammunition cartridges in a loading position. The ammunition loading tray includes one or more loading recesses. Each loading recess is configured to receive an ammunition magazine and allow for less lateral movement of the ammunition magazine in a first direction while allowing lateral movement of the ammunition magazine in a second direction that is perpendicular to the first direction. An ammunition cartridge holder is located within a respective one of the one or more loading recesses. The ammunition cartridge holder is open from above and is configured to support the ammunition cartridge from below. The ammunition cartridge holder is further configured to limit lateral movement of the ammunition cartridge in the first direction while allowing lateral movement of the ammunition cartridge in the second direction.

In another aspect of the technology, a firearm magazine loading system includes a loading tray with one or more loading compartments. Each loading compartment is configured to receive an ammunition cartridge and hold the ammunition cartridge in place. Each loading compartment comprises a floor with a central recess and a pair of raised portions on opposite sides of the recess, a front wall, and a pair of opposing side walls extending from the front wall and or a rear side of the loading compartment. A length of the recess in the floor is greater than a length of the raised portions of the floor.

The rear wall of the loading compartment may be inclined in a rearward direction. The recess may extend beyond the raised portions of the floor. The recess may be configured to prevent lateral and/or rotational movement of the ammunition cartridge when the ammunition cartridge is positioned in the recess. The loading compartment may be sized to receive ammunition cartridges of different sizes. The recess may be configured to prevent lateral and/or rotational movement of the ammunition cartridge when the ammunition cartridge is positioned in the recess regardless of the size of the ammunition cartridge.

A distance between the side walls may be great enough to receive a firearm magazine while preventing or minimizing lateral movement of the magazine. The forward wall may comprise a central offset portion that is outwardly offset from the rest of the forward wall. The recessed portion of the floor of the loading compartment may extend to the central offset portion of the forward wall, and the raised portions of the floor of the loading compartment extends to the parts of the forward wall that are not outwardly offset. The loading tray may further comprise one or more storage compartments. The one or more storage compartments may be configured to hold one or more ammunition cartridges and/or a firearm magazine. The firearm magazine loading system may further comprise a firearm magazine.

In another aspect of the technology, a firearm loading system includes a firearm magazine loading system, a firearm magazine, and a firearm.

In yet another aspect of the technology, a method for loading a firearm magazine includes positioning one or more ammunition cartridges into corresponding loading compartments of an ammunition loading tray. In addition, a loading end of an ammunition magazine is positioned against a floor of the loading compartment at an inclined orientation. The ammunition magazine is rotated or pivoted forward to press a portion of the ammunition cartridge into the ammunition magazine. In addition, the ammunition magazine is slid forward so that the ammunition cartridge slides into the ammunition magazine.

The ammunition magazine may include a follower and a spring that biases the follower toward the loading end of the ammunition magazine. During the rotating or pivoting step, the ammunition magazine may be pivoted around a lower rear edge of the ammunition magazine. The loading compartment may limit lateral movement of the ammunition cartridge and may limit lateral movement of the ammunition magazine. The ammunition magazine may remain in contact with a floor of the loading compartment as the ammunition magazine is slid forward.

The loading compartment may limit the forward movement of the ammunition magazine so that a front tip of the ammunition cartridge is further forward than the furthest extent of the forward movement of the ammunition magazine when the ammunition cartridge is positioned in the loading compartment. In addition, the loading compartment may include a floor with a central recess and a pair of raised portions on opposite sides of the recess, a rear wall, a front wall opposite the rear wall, and a pair of opposing side walls extending from the rear wall to the front wall. A length of the recess in the floor may be greater than a length of the raised portions of the floor.

In yet another aspect of the technology a method for loading a firearm magazine includes positioning one or more ammunition cartridges into corresponding loading compartments of an ammunition loading tray, positioning one or more ammunition cartridges into corresponding loading compartments of an ammunition loading tray, positioning a loading end of an ammunition magazine vertically above the ammunition cartridge, moving the ammunition magazine downward toward the loading compartment, and pressing the ammunition magazine against the ammunition cartridge until the ammunition cartridge is fully received within the ammunition magazine.

The ammunition magazine may have a follower and a spring that biases the follower toward the loading end of the ammunition magazine. The ammunition magazine may include a pair of feeder lips, and pressing the ammunition magazine against the ammunition cartridge pushes the ammunition cartridge through a gap between the feeder lips. The loading compartment may limit lateral movement of the ammunition cartridge and limits lateral movement of the ammunition magazine. The loading compartment may limit the forward movement of the ammunition magazine so that a front tip of the ammunition cartridge is further forward than the furthest extent of the forward movement of the ammunition magazine when the ammunition cartridge is positioned in the loading compartment.

The loading compartment may include a floor with a central recess and a pair of raised portions on opposite sides of the recess, a front wall, and a pair of opposing side walls extending from the front wall and/or a rear side of the loading compartment. A length of the recess in the floor may be greater than or equal to a length of the raised portions of the floor.

DETAILED DESCRIPTION OF EXAMPLE NON-LIMITING EMBODIMENTS

Figure 1:
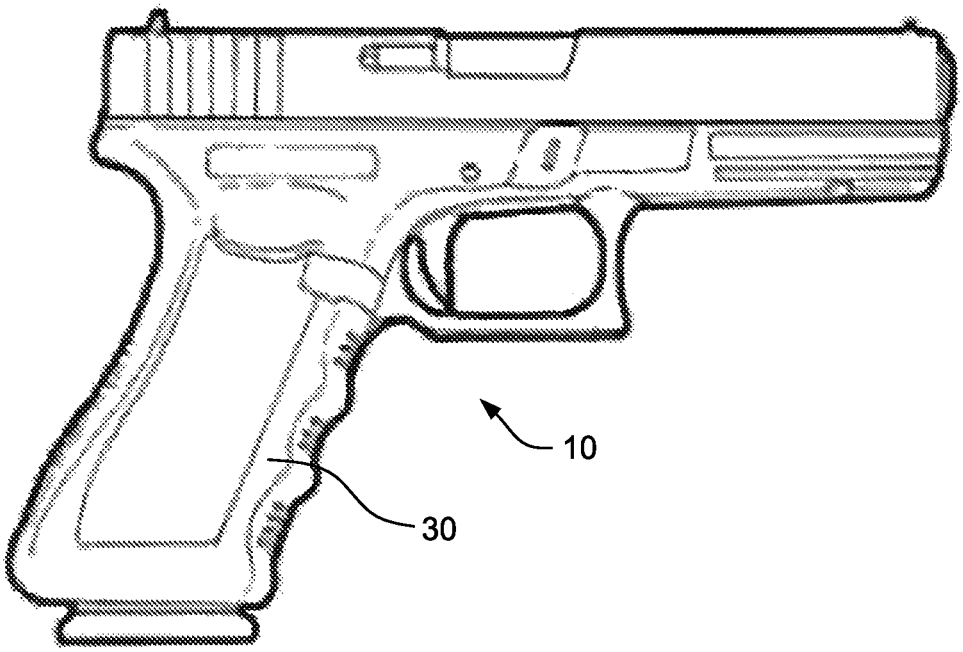
FIG. 1 shows an exemplary firearm.
Figure 2:
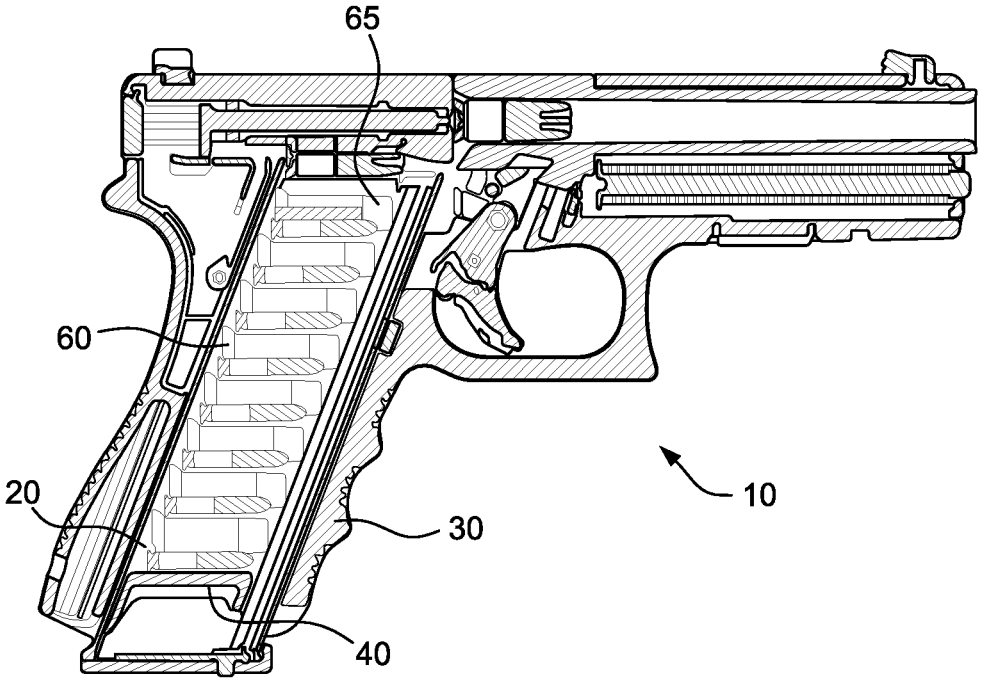
FIG. 2 shows a cutaway view of the firearm of FIG. 1.

FIGS. 1 and 2 show an exemplary firearm 10. Although the drawings depict a handgun, it should be understood that the invention is not limited the loading of a handgun. The firearm loading system can also be used with a shotgun, a rifle, or any other type of firearm that uses a magazine.

FIG. 2 shows a cutaway view of the firearm 10. As can be seen, a magazine 20 may be positioned within a hand grip 30 of the firearm 10. For other types of firearms 10, the magazine 20 may be secured at other locations.

Figure 3:
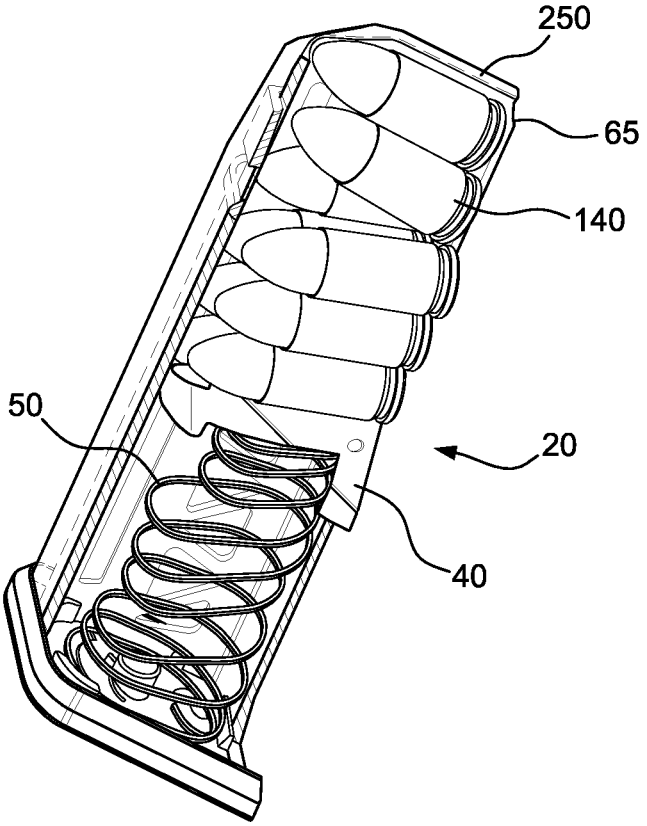
FIG. 3 shows a cutaway view of an exemplary a magazine for a firearm.

As can be seen in FIG. 3, the magazine 20 may include a follower 40 attached to an end of a spring 50. Ammunition 60 may be loaded into the magazine 20 through an opening in a loading end 65 of the magazine 20. The loading end 65 of the magazine may also be the portion of the magazine 20 from which the ammunition 60 is loaded into the barrel chamber. The spring 50 and the follower 40 may bias the ammunition 60 toward a loading end 65 of the magazine 20.

Figure 4:
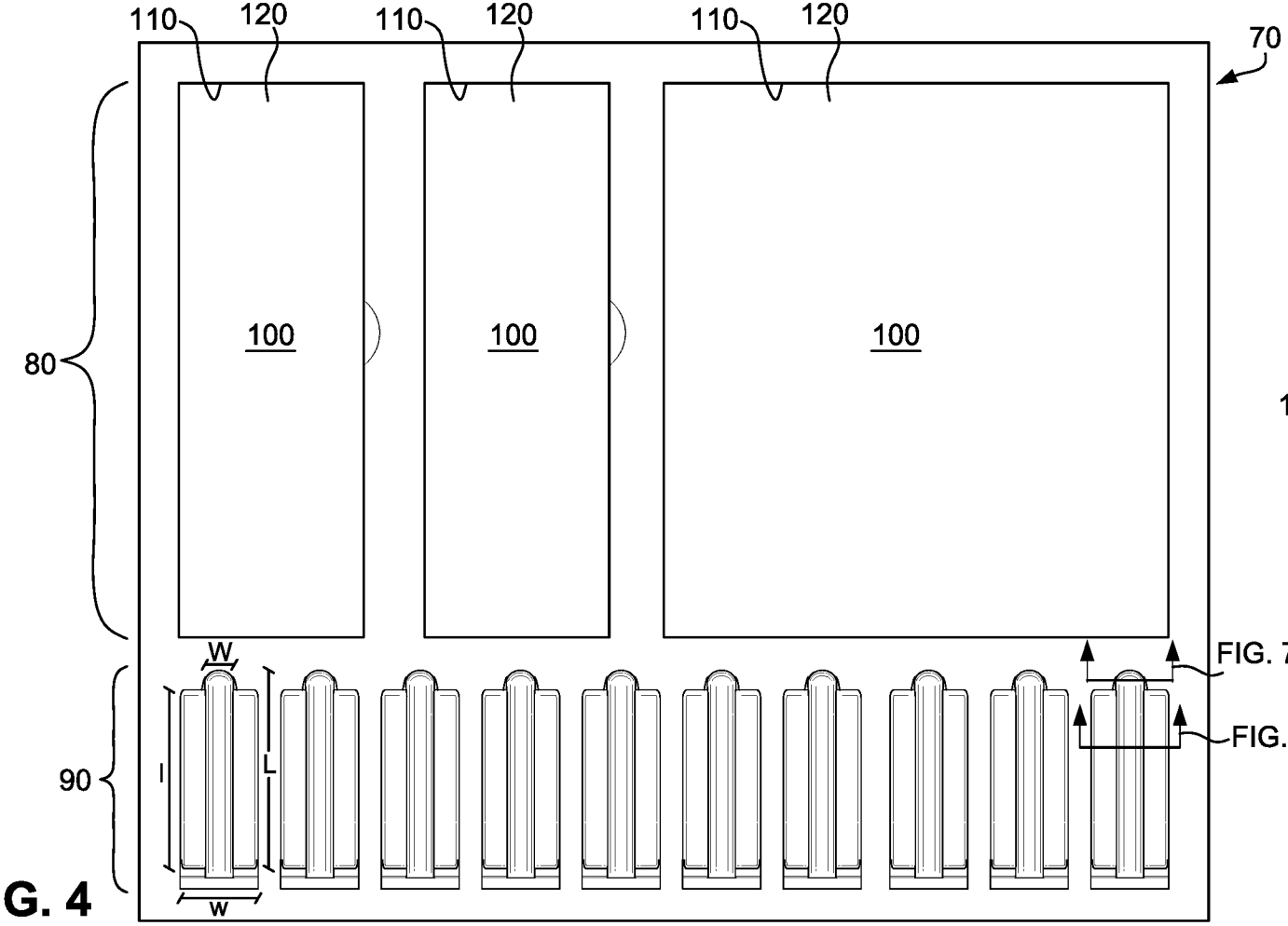
FIG. 4 is a top view of a magazine loading tray.
Figure 6:
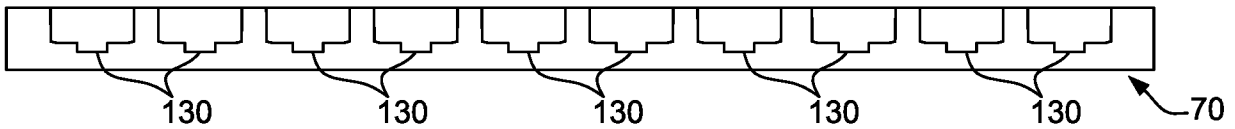
FIG. 6 is a rear view the magazine loading tray of FIG. 4.

FIG. 4 shows an ammunition loading tray 70 that may be used to load a magazine 20 with ammunition 60. Although FIG. 4 shows the loading tray 70 with a square-shaped perimeter, the perimeter of the loading tray 70 may have any shape (e.g., circular, ovoid, rectangular, triangular, etc.). The loading tray 70 may include a storage or staging section 80 and a loading section 90. Although FIG. 4 shows the storage section 80 being on one side of the loading tray 70 and the loading section 90 being on the other side of the loading tray 70, the loading tray 70 may have other configurations. For example, the storage section 80 may be positioned at the perimeter of the loading tray 70 and the loading section 90 may be in the middle of the loading tray 70. In yet another example, the storage section 80 may be positioned in the middle of the loading tray 70 and the loading section 90 may be in positioned at the perimeter of the loading tray 70 around the storage section 80. It should be understood that the layout of the loading tray 70 is not limited to the configurations discussed above.

The storage section 80 may have one or more storage or staging compartments (or cavities) 100. It is contemplated that the loading tray 70 may optionally not have any storage compartments 100 or a storage section 80.

Figure 9:
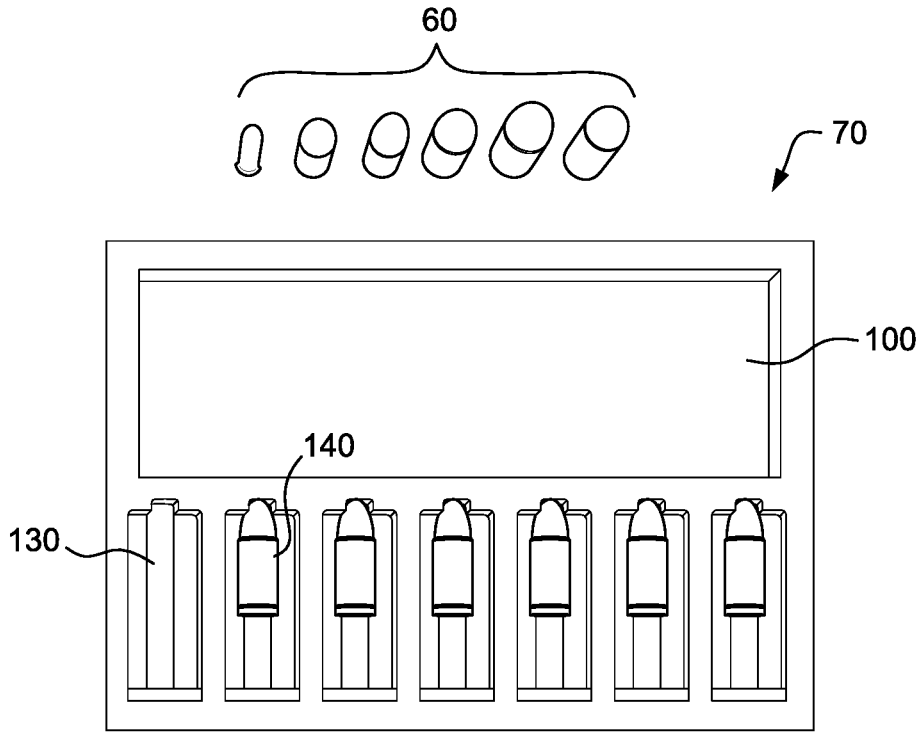
FIG. 9 is a view of a magazine loading tray loaded with ammunition.
Figure 10:
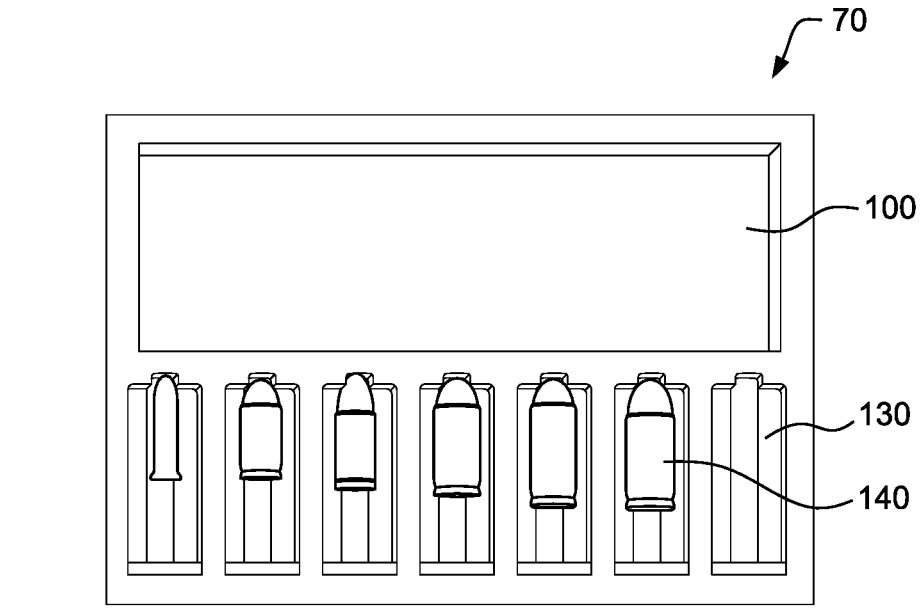
FIG. 10 is a view of a magazine loading tray loaded with ammunition.
Figure 11:
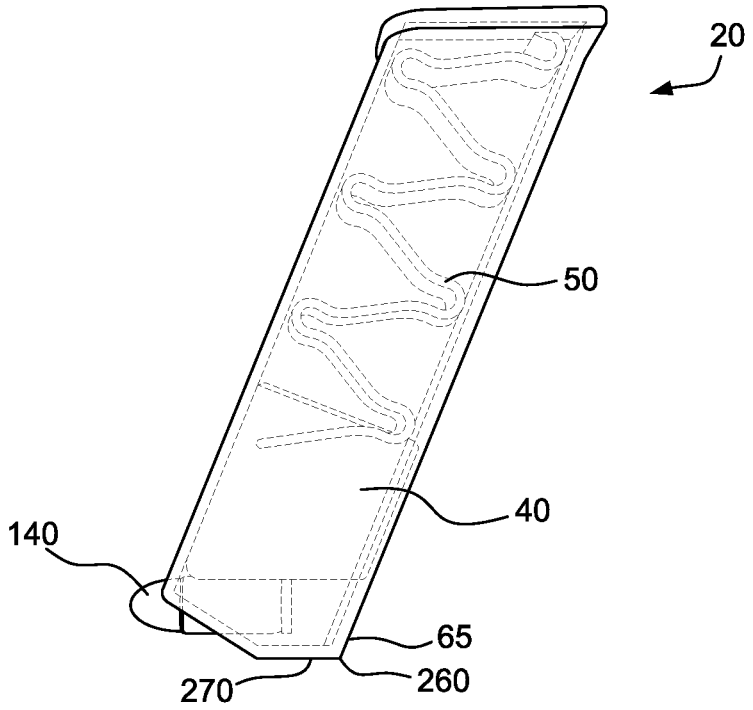
FIG. 11 is a cutaway view of a magazine oriented for loading ammunition.
Figure 13:
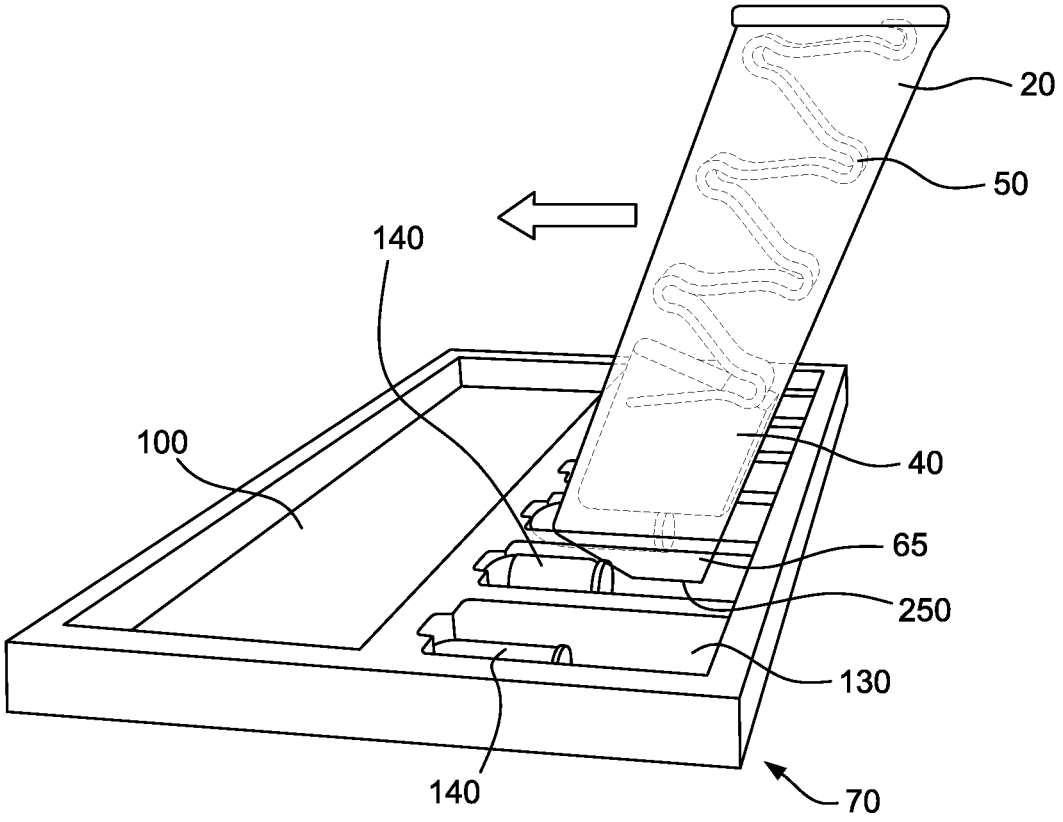
FIG. 13 shows the magazine being loaded with ammunition positioned in the magazine loading tray.
Figure 14:
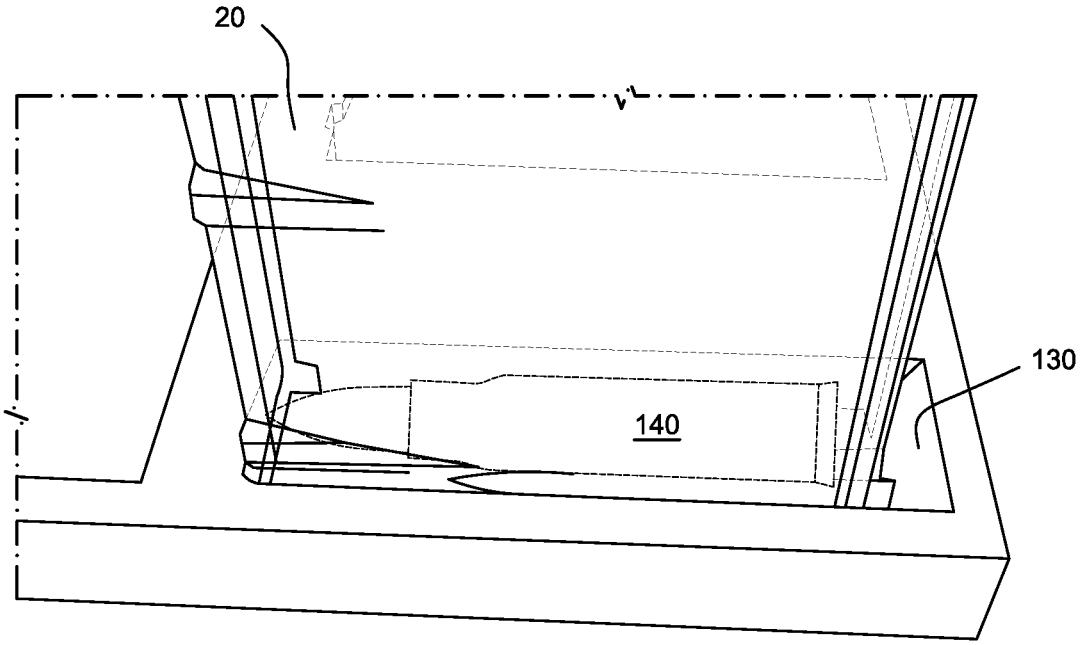
FIG. 14 shows the magazine being loaded with ammunition positioned in the magazine loading tray.

The storage compartments 100 may be designed to hold the magazine 20 and/or the ammunition 60 prior to the ammunition 60 being loaded into the magazine 20 or when the loading tray 70 is not being used to load ammunition 60 into the magazine 20. Although FIG. 4 shows three storage compartments 100, the storage section 80 may include any number of storage compartments 100. For example, as shown in FIGS. 9, 10, and 13, the storage section 80 may include only one storage compartment 100. In addition, the storage compartments 100 of the storage section 80 may have the same shape and size or different sizes and shapes.

The storage compartments 100 may include one or more side walls 110 and a floor 120. A top side of the storage compartments 100 may be open. In addition, the storage compartments 100 may be enclosed by a cover (not shown). The cover may be designed to cover the entirety of the loading tray 70. Alternatively, the storage section 80 and the loading section 90 may have their own separate covers or only the storage section 80 has a cover. It is further contemplated that each storage compartment 100 may have its own cover. The cover (or covers) may be completely removable from the loading tray 70 or may be hingedly attached to the loading tray 70. By including a cover, the loading tray 70 may be usable as a storage container for the ammunition 60 and/or one or more magazines 20 when they are not in use.

The loading section 90 may include one or more loading compartments (or cavities) 130. Each loading compartment 130 may be designed to hold an ammunition cartridge 140 in place so that it can be loaded into the magazine without being held or touched by a user during the loading process. FIG. 4 shows an array of ten loading compartments 130 in a side-by-side arrangement. However, the loading tray 70 is not limited to this configuration. The loading section 90 may have any number of loading compartments 130 including only one. In addition, the loading compartments 130 may be positioned in any configuration (e.g., staggered, bunched together in the middle of the loading tray 70, etc.).

Each loading compartment 130 may be in the form of a recess and may have a pair of opposing side walls 150, a floor 160, a rear wall 170, and a front wall 180. In addition, a top side of each loading storage compartment 130 may be open. The loading compartment 130 may optionally omit the rear wall 170 so that the rear side of the loading compartment 130 is open instead of closed. Also, the loading compartment 130 may optionally omit the front wall 180 so that the front side of the loading compartment 130 is open instead of closed. In addition, although the side walls 150 are shown as being continuous from the front wall 180 to the rear wall 170, the side walls 150 may be intermittent, may extend only from the front wall 180, may extend only from the rear wall 170 (or a rear side of the loading compartment 130), or may be positioned between the front and rear sides of the loading compartment 130 without extending all the way to either of the front or rear sides of the loading compartment 130.

The width of the loading compartment 130 (or the distance between the side walls 150) may be wide enough to receive the loading end 65 of the magazine 20 while also preventing or minimizing lateral movement of the magazine 20 toward and away from the side walls 150. The length of the loading compartment 130 (or the distance between the front wall 180 and the rear wall 170) may be long enough to allow more lateral movement in the forward and rearward direction (i.e., respectively toward and away from the front wall 180 and the rear wall 170). In other words, the loading compartment 130 may configured so that lateral movement of the magazine 20 in a first direction (e.g., side-to-side) is more restricted than lateral movement of the magazine 20 in a second direction perpendicular to the first direction (e.g., forward and rearward).

The floor 160 may include a centrally located recess (or channel) 190 extending from the rear wall 170 to the front wall 180. The recess 190 may divide the remaining portions of the floor 160 into shelves 200 on opposite sides of the recess so that the shelves 200 are separated from each other by the recess 190. The loading compartment 130 may be deeper at the recess 190 than at the shelves 200. In addition, it is contemplated that depth of the loading compartment 130 may be the same at both shelves 200. The recess 190 may form the portion of the loading compartment 130 that holds the ammunition cartridge 140 in place during the magazine loading process. Each shelf 200 may extend from the recess 190 to a corresponding one of the side walls 150. The widths of the shelves 200 may be the same.

A width of the recess 190 may be less than the diameter of the ammunition cartridge 140 so that only a portion (e.g., less than half) of the cartridge rests below the shelves 200. The depth of the recess 190 may also allow a portion (e.g., less than half) of the ammunition cartridge 140 be above the top of the side walls 150 and the front wall 180. In addition, the depth and width of the recess 190 may be large enough to prevent the ammunition cartridge 140 from moving or rotating laterally. The depth of the recess 190 may also be small enough to hold the ammunition cartridge 140 in place while at the same time allowing the ammunition cartridge 140 to be captured by the magazine 20 during the loading process. It is contemplated that the loading end 65 of the magazine 20 may engage the shelves 200 during the loading process and that the shelves 200 may prevent the magazine 20 from engaging the portion of the floor 160 in the recess 20.

The width of the recess 190 (or the distance between the shelves 200) may be wide enough to receive the ammunition cartridge 140 while also preventing or minimizing lateral movement of the ammunition cartridge 140 toward and away from the shelves 200. The length of the recess 190 (or the distance between the front wall 180 and the rear wall 170) may be long enough to allow more lateral movement in the forward and rearward direction (i.e., respectively toward and away from the front wall 180 and the rear wall 170). In other words, the recess 190 may configured so that lateral movement of the ammunition cartridge 140 in a first direction (e.g., side-to-side) is more restricted than lateral movement of the ammunition cartridge 140 in a second direction perpendicular to the first direction (e.g., forward and rearward).

Figure 7A:
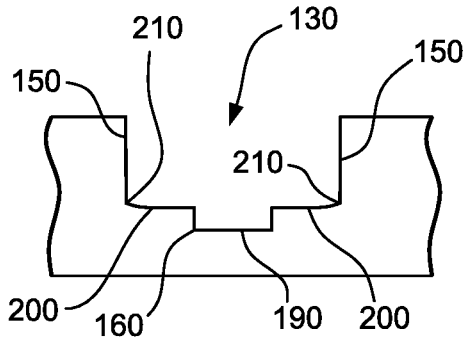
FIGS. 7A-7C are sectional views of one of the ammunition holding compartments of the magazine loading tray of FIG. 4.
Figure 7B:
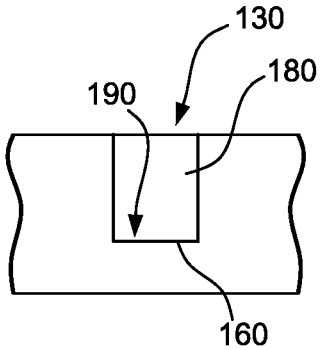

As can be seen in FIG. 7A, the side walls 150 may meet the shelves 200 of the floor 160 at edges 210. Although the edges 210 are illustrated without being chamfered, beveled, or curved, the edges 210 may optionally be chamfered, beveled, or curved. Similarly, the edge 220 between the side walls of the recess 190 and the floor of the recess 190 may optionally be chamfered, beveled, or curved. In addition, it is contemplated that the floor of the recess 190 may be planar. Alternatively, the floor of the recess 190 may be concave with the deepest part of the recess 190 being at the center of the recess 190. In addition, the perimeter of each shelf 200 may be rectangular. The perimeter of the recess 190 may also be rectangular. Alternatively, the perimeter of the recess 190 may have three planar sides and a curved (or concave) fourth side. It should be understood that the perimeter of the recess 190 is smaller than the combined perimeters of the shelves 200 and is smaller than the perimeter of the loading compartment 130.

FIG. 7A shows the top surface of each shelf 200 as being substantially horizontal. Alternatively, the top surface of each shelf 200 may be sloped toward the side walls 150 so that the top surface of each shelf 200 is highest at the rim of the recess and is lowest at the edge 210 (FIGS. 7I-7K). In yet another alternative configuration, the top surface of each shelf 200 may be sloped toward the recess 190 so that the top surface of each shelf 200 is highest at the side walls 150 (FIGS. 7L-7N).

Figure 5:
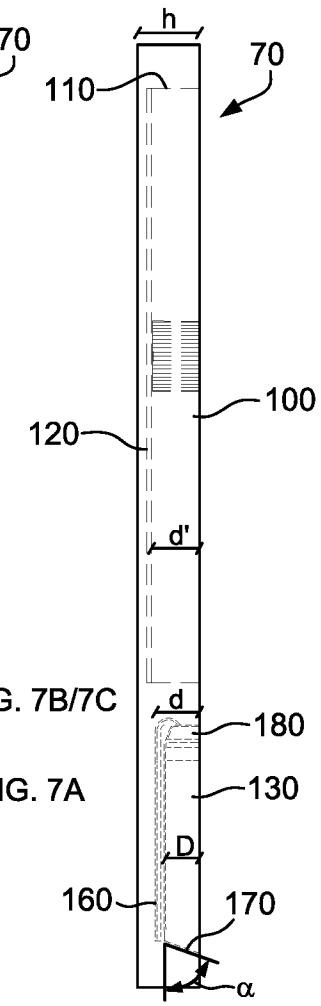
FIG. 5 is a side view of the magazine loading tray of FIG. 4.

Referring back to FIG. 5, the rear wall 70 of the loading compartment 130 may extend upward from the floor 160. The rear wall 170 may extend at an angle $\alpha$ so that the wall projects upwardly and rearwardly from the floor 160. In other words, the rear wall 170 may be rearwardly inclined. The angle $\alpha$ may be measured between the rear wall 170 and the floor 160. It is contemplated that the angle $\alpha$ may be less than 90 degrees. The angle $\alpha$ may be the angle at which the rear side 255 of the magazine 20 is oriented when the magazine 20 is initially positioned in the loading compartment 130 during the process of loading the ammunition cartridges 150 into the magazine 20.

As can be seen in FIGS. 4, 7B, 7D, and 7E, the front wall 180 may include lateral portions 230 and a central offset portion 240 that extends beyond the lateral portions 230. The lateral portions 230 extend upwards from the respective shelves 200 and extend laterally toward the side walls 150. The lateral portions 230 may form a barrier that limits the forward movement of the magazine 20 while the magazine 20 is positioned within the loading compartment 130.

The offset portion 240 may extend beyond the lateral portions 230. In addition, the recess 190 may extend to the offset portion 240 beyond the lateral portions 230. Accordingly, the recess 190 may be longer than the rest of the floor 160 (i.e., longer than the shelves 200), which terminates at the lateral portions 230. In addition, the offset portion 240, at its widest, may have the same width as the recess 190. The offset portion 240 may be planar or may be concave.

Figure 7C:
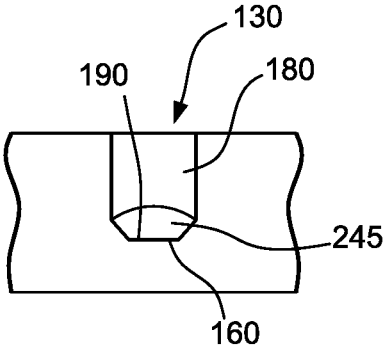

In addition, as can be seen in FIG. 7C, the offset portion 240 may include a concave portion 245. The concave portion 245 may form a concave recess in the offset portion 240. In addition, the concave recess may receive the tip of the ammunition cartridge 140. The concave portion 245 may be positioned at a lower part of the front wall 180 and may be positioned so that it is aligned with the tip of the ammunition cartridge 140 when the ammunition cartridge 140 is in a forwardmost position in the recess 190.

Figure 7D:
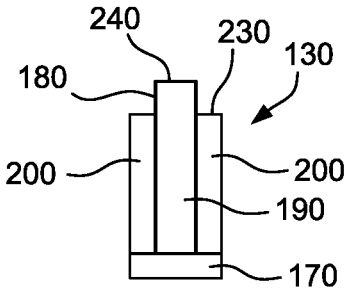
FIG. 7D is a top view of an exemplary ammunition holding compartment of a magazine loading tray.
Figure 7E:
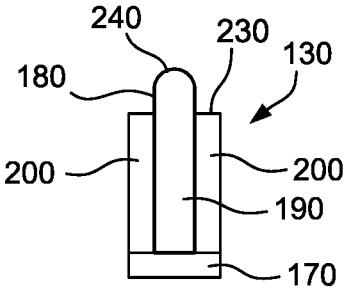
FIG. 7E is top view of another exemplary ammunition holding compartment of a magazine loading tray.

The portion of the loading compartment 130 that receives the ammunition cartridge 140 may be longer than the portion of the loading compartment 130 that receives the magazine 20 (FIGS. 7D and 7E). This way, when the ammunition cartridge is in position for loading into the magazine 20, the tip of the ammunition cartridge 140 may be positioned further forward than a forwardmost position of the magazine during the loading operation.

Figure 7F:
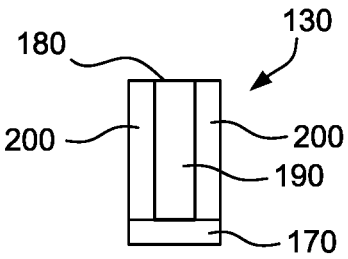
FIG. 7F is top view of another exemplary ammunition holding compartment of a magazine loading tray.

Alternatively, the front wall 180 of the loading compartment 130 may not have a central offset portion (FIG. 7F). In other words, the front wall 180 may have a continuous planar surface extending from one side wall 150 to the other side wall 150. In this configuration, the recess 190 may have the same length as the shelves 200. The configuration without the central offset portion may accommodate ammunition cartridges 140 with more rounded tips (e.g., those ammunition cartridges that have a more cylindrical shape). It is contemplated that the loading section 90 may include a mix of loading compartments 130 (i.e., loading compartments 130 with a central offset portion 240 and loading compartments 130 without a central offset portion 130). It is further contemplated that the loading section 90 may only include one type of loading compartment 130 (i.e., only loading compartments 130 with central offset portions 130 or only loading compartments 130 without central offset portions 130).

In one exemplary configuration, the height h of the loading tray may be between 10 and 30 mm (e.g., about 14 mm). The depth d' of the storage compartments 100 may be between 5 and 15 mm (e.g., about 6 mm). The depth D of the loading compartment 130 at the shelves 200 may be between 2 and 11 mm (e.g., about 9.65 mm). The depth d of the loading compartment 130 at the recess 190 may be between about 2 and 13 mm (e.g., about 11.69 mm). The length 1 of the shelves 200 may be between about 45 and 50 mm (e.g., about 45.49 mm). The length L of the recess 190 may be between about 51 and 55 mm (e.g., about 52.19 mm). The maximum width W of the front wall 180 may be the same as the width of the recess 190 and may be between about 8 and 10 mm (e.g., about 8.49 mm). The width w of the loading compartment 130 at the shelves 200 may be between 9 and 20 mm. The angle $\alpha$ may be between 60 and 90 degrees (e.g., about 70.25). In addition, the maximum depth of the recess 190 may be between 1 and 3 mm (e.g., 2 mm).

Figure 7G:
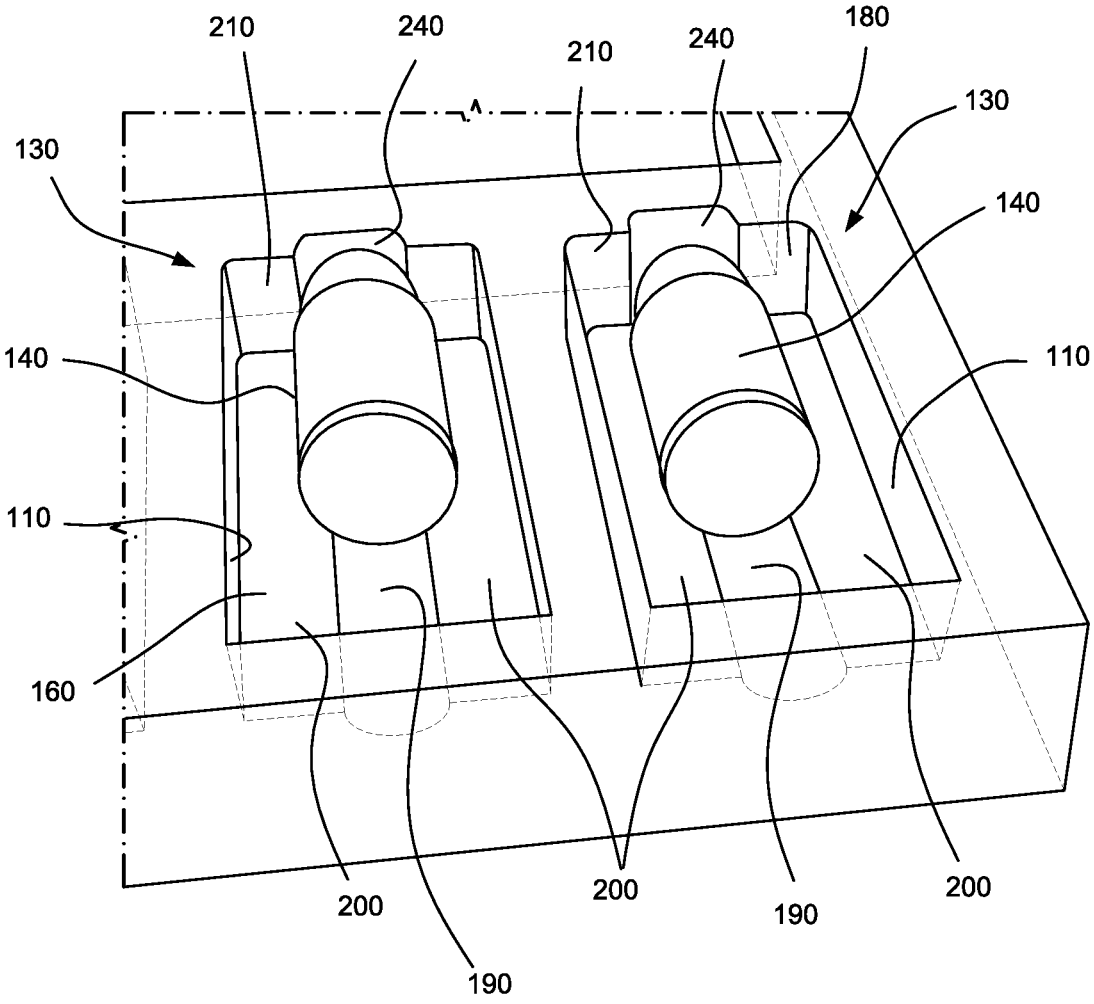
FIG. 7G is a perspective view of another exemplary ammunition holding compartment of a magazine loading tray.
Figure 7H:
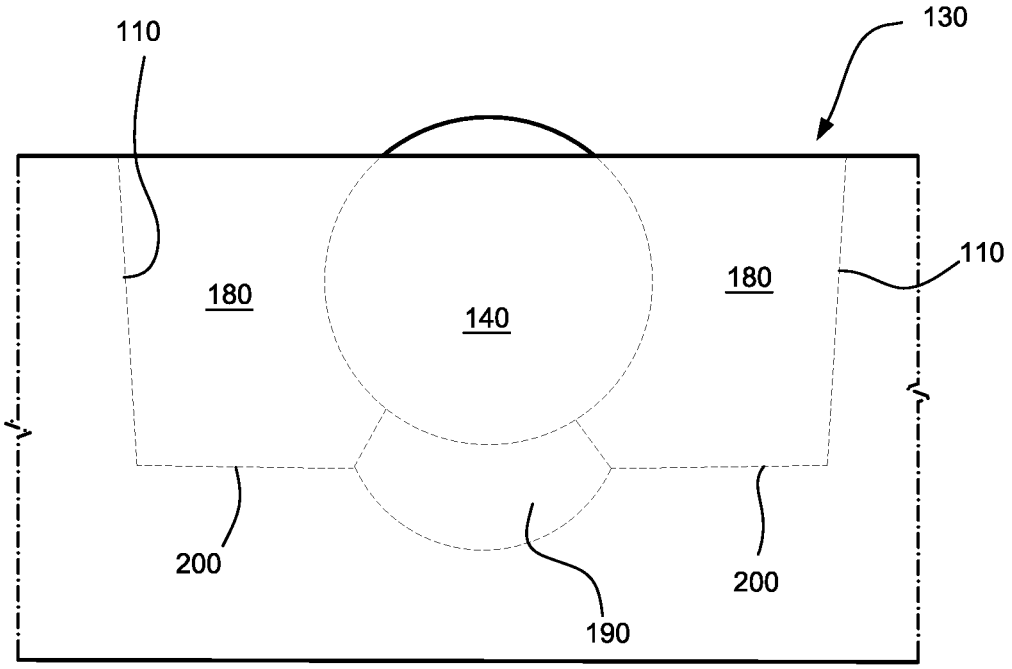
FIG. 7H is a rear view of the ammunition holding compartment of FIG. 7G.
Figure 7I:
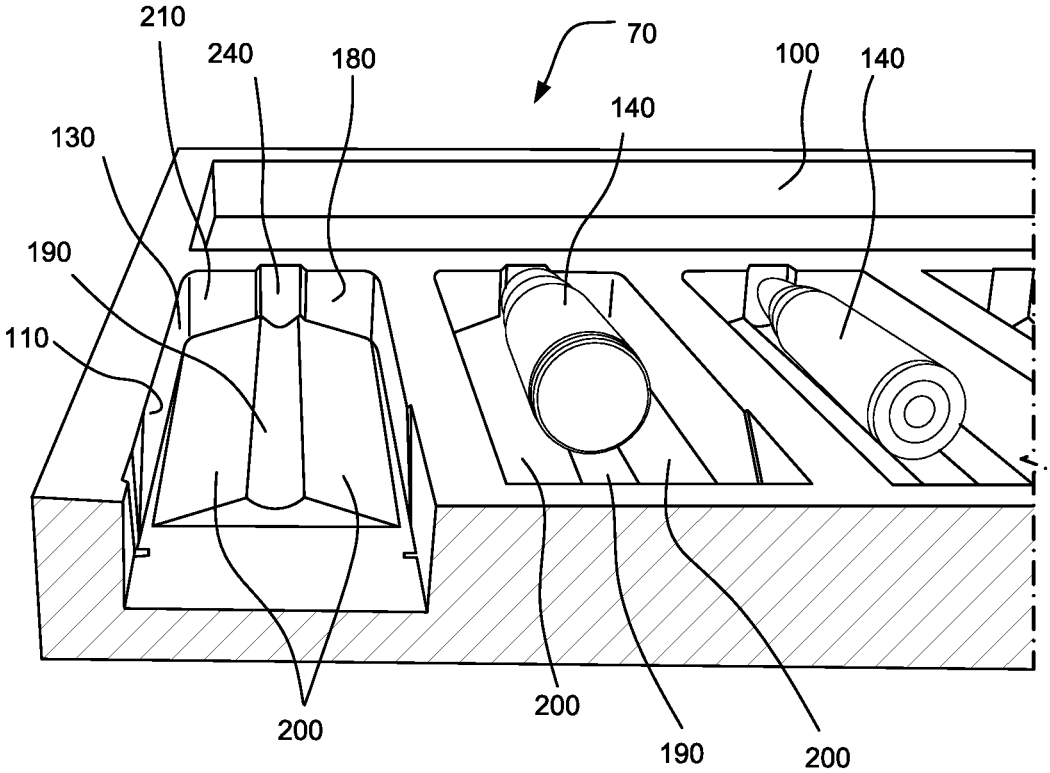
FIG. 7I is a perspective view of another exemplary ammunition holding compartment of a magazine loading tray.
Figure 7J:
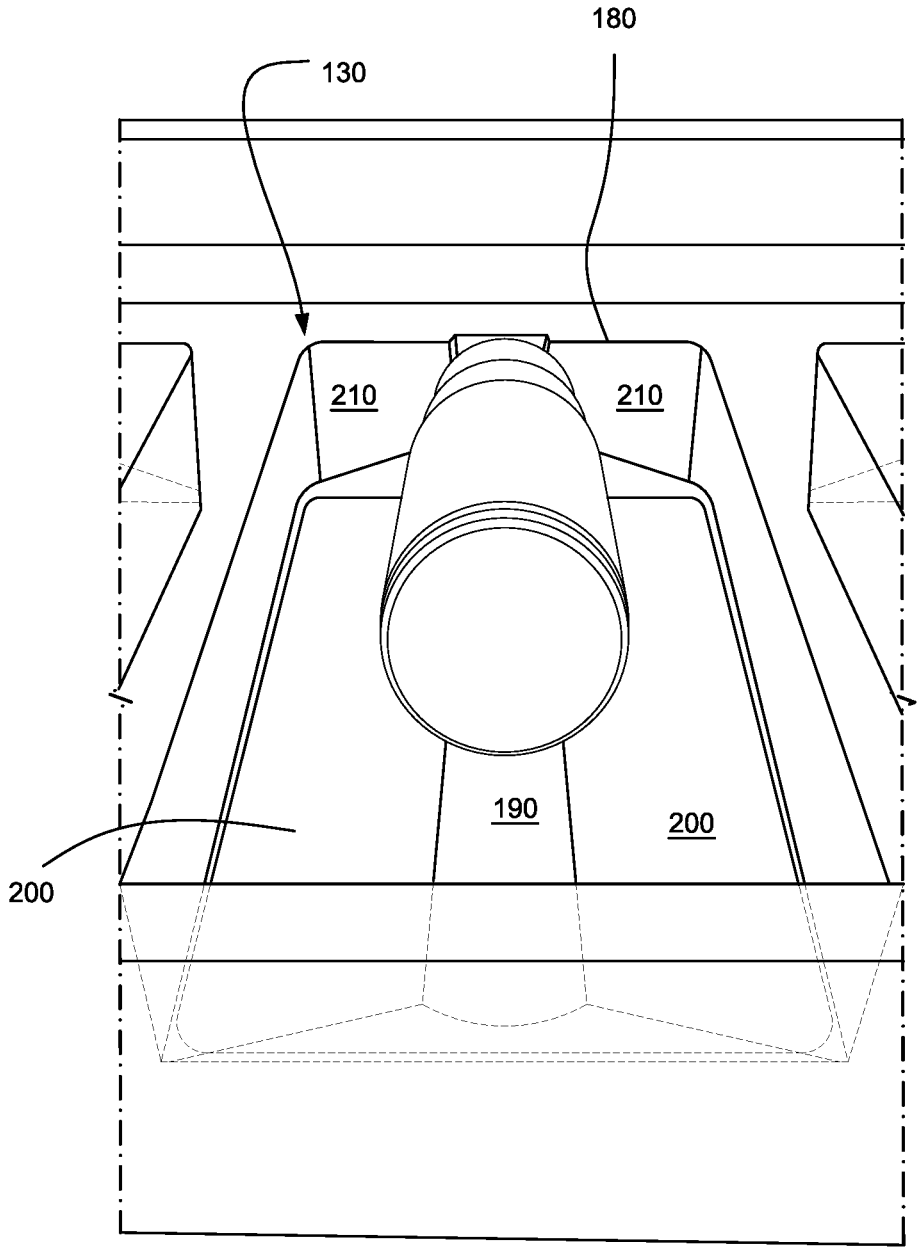
FIG. 7J is another perspective view of the ammunition holding compartment of FIG. 7I.
Figure 7K:
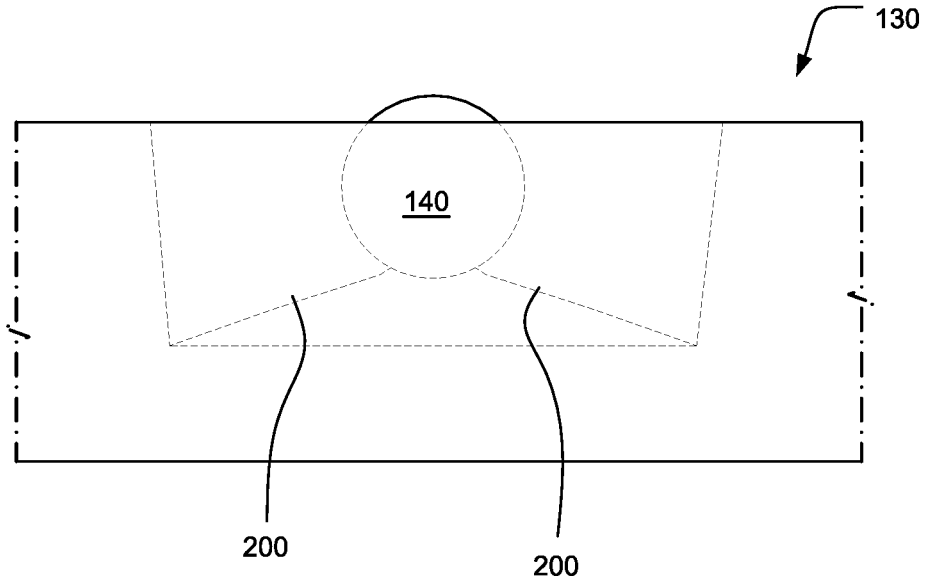
FIG. 7K is a rear view of the ammunition holding compartment of FIG. 7I.
Figure 7L:
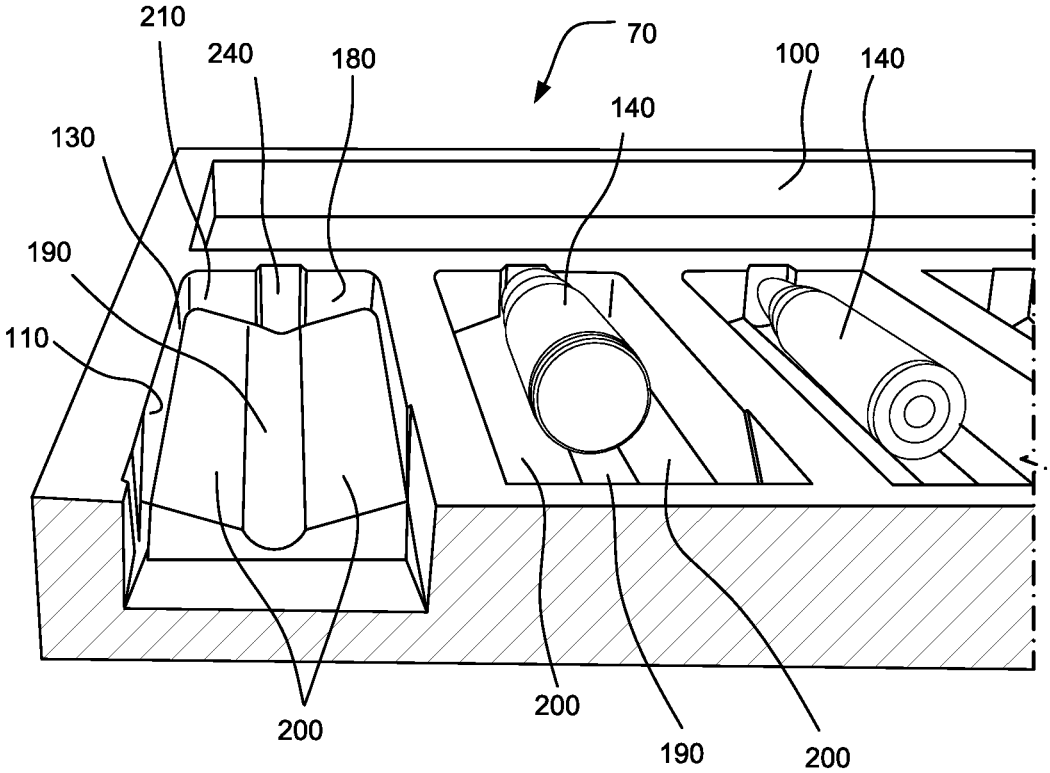
FIG. 7L is a perspective view of another exemplary ammunition holding compartment of a magazine loading tray.
Figure 7M:
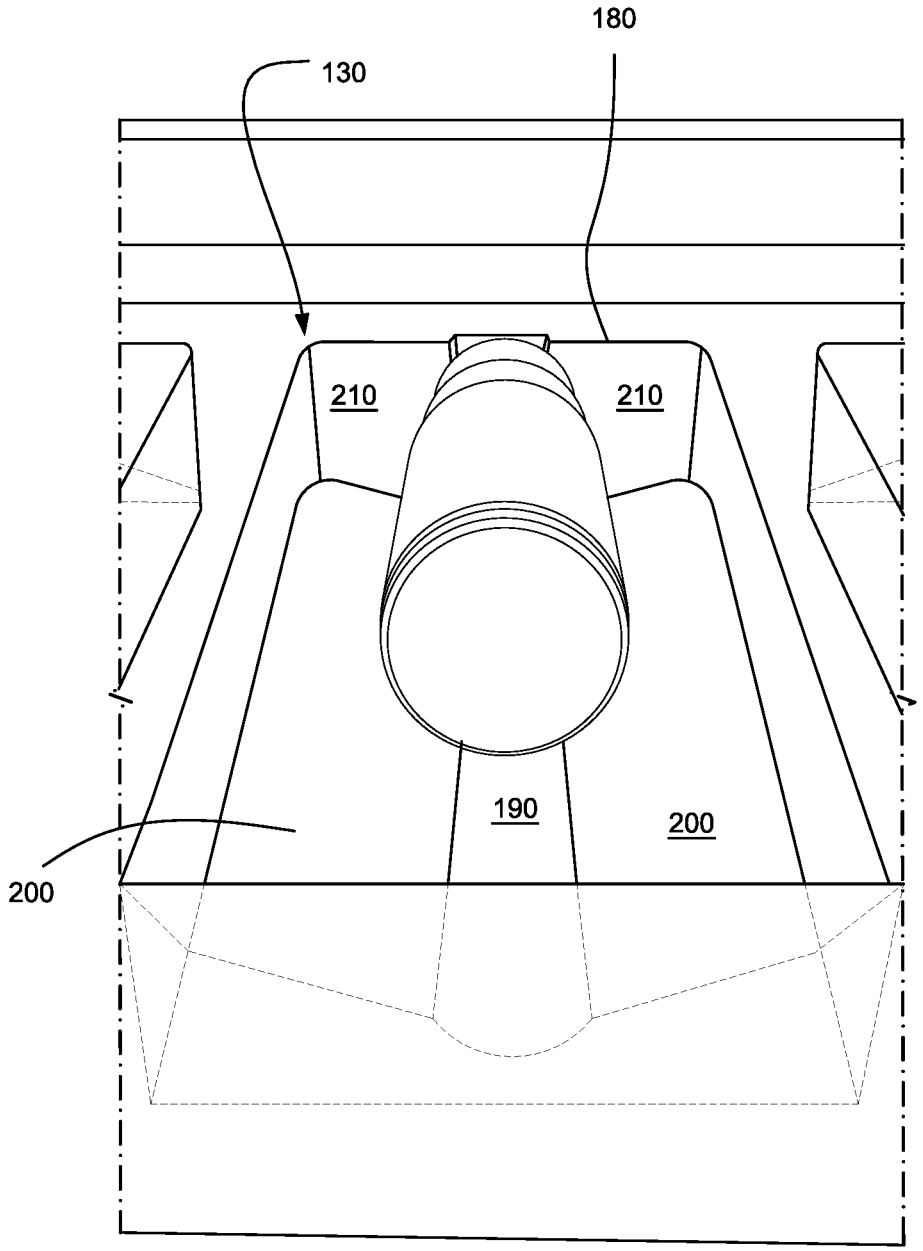
FIG. 7M is another perspective view of the ammunition holding compartment of FIG. 7L.
Figure 7N:
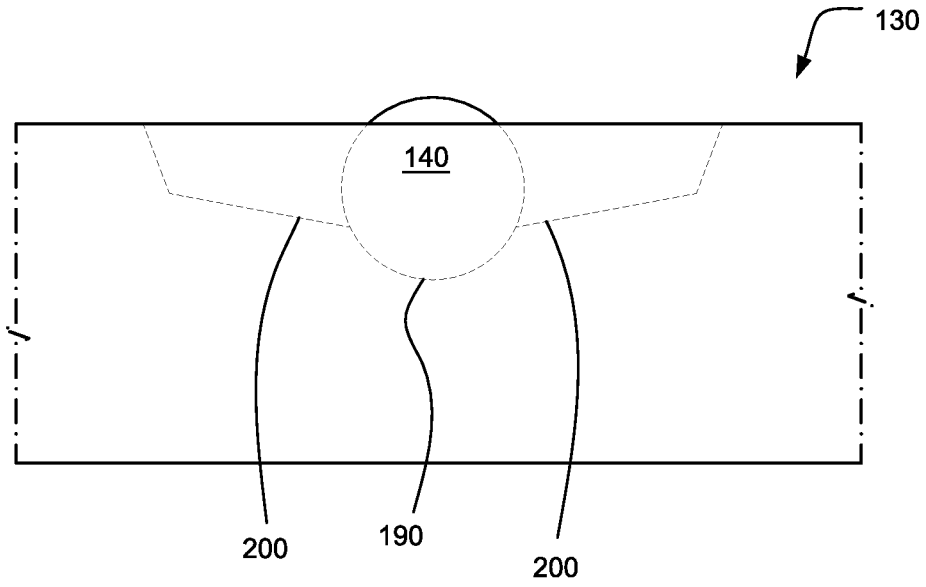
FIG. 7N is a rear view of the ammunition holding compartment of FIG. 7L.

FIGS. 7G and 7H show ammunition cartridges 140 positioned in respective loading compartments 130. As can be seen, the diameter of each ammunition cartridge 140 may be greater than the width of the recess 190 so that a portion of the ammunition cartridge 140 extends beyond the sides of the recess 190 when the ammunition cartridge 190 is located in the loading position. This configuration may allow the feed lips 250 to slide under a portion of the ammunition cartridge 140 and load the ammunition cartridge 140 into the magazine 20.

In addition, when the top surface of the shelf 200 is substantially horizontal (FIGS. 7G and 7H), the lowest part of the recess 190 may be below the entire top surface of the shelf 200. Alternatively, the top surface of the shelves 200 may be sloped, either toward the recess 190 (FIGS. 7I-7J) or away from the recess (FIGS. 7K-7N). When the top surface of the shelf 200 is sloped away from the recess 190 (FIGS. 7I-7K), the lowest part of the recess 190 may be above the part of the shelf 200 at the edge 210. Alternatively, the lowest part of the recess 190 may be at the same level as or below the part of the shelf 200 at the edge 210.

In all of the configurations of the loading compartment 130, the floor 160 may be configured so that the ammunition cartridge 140 naturally rests in a loading position in a central region of the loading compartment 130. Thus, the combination of gravity and the geometry of the loading compartment 130 may automatically position the ammunition cartridge 140 in the loading position.

Figure 8A:
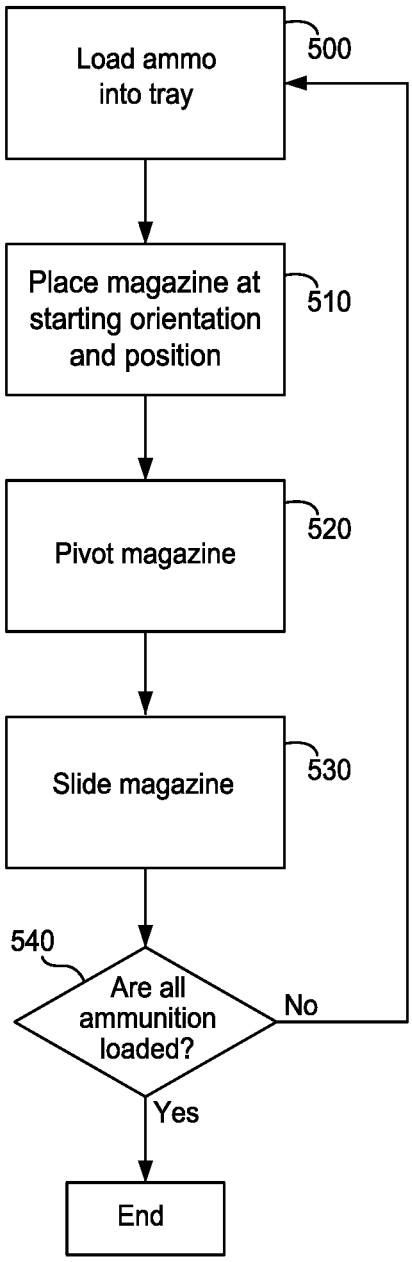
FIG. 8A is a flow diagram showing a method for loading a magazine.

FIG. 8A shows a flow diagram for a method of loading the ammunition cartridge 140 into the magazine 20. In the first step 500, the ammunition cartridges 140 are placed in the loading compartments 130. Not all of the loading compartments 130 need be loaded, and any number of loading compartments 130 may be loaded. When positioning the ammunition cartridge 140 into the loading compartment 130, the ammunition cartridge 140 may be positioned in the recess 190 and as far forward as possible so that a front tip of the ammunition cartridge 140 extends beyond the lateral portions 230 of the front wall 180. It is contemplated that the tip of the ammunition cartridge 140 may abut the offset portion 240 of the front wall 180. For configurations lacking a central offset portion 140, the ammunition cartridge merely abuts the front wall 180. The narrower width of the loading compartment 130 in the recess 190 and offset portion 240 helps stabilize the ammunition cartridge 140 and restricts lateral movement of the ammunition cartridge 140 during the loading process.

In addition, as can be seen in FIG. 10, each loading compartment 130 is designed to be able to receive different caliber cartridges. In other words, the loading compartments 130 are not limited to a single caliber cartridge.

After the ammunition cartridges 140 have been loaded into the loading compartments 130, the loading end 65 of the magazine 20 may be inserted into the loading compartment 130 (step 510). The loading end 65 of the magazine 20 may include a pair of feed lips 250 that extend inwardly from the sides of the magazine housing (see FIG. 3). The feed lips 250 may retain the ammunition cartridge 140 in the magazine 20 after it has been loaded. The feed lips 250 are positioned to prevent the ammunition cartridge 140 from being pushed out of the magazine 20 by the spring 50. However, the feed lips 250 do not extend the length of the loading end 65 of the magazine 20. Thus, the opening in the forward portion of the loading end 65 of the magazine 20 is wider than where the feed lips 250 are. Typically, the ammunition cartridge 140 is loaded into the magazine 20 through the wider opening at the forward portion of the loading end 65 of the magazine and then slid between the follower 40 and the feed lips 250.

Figure 12:
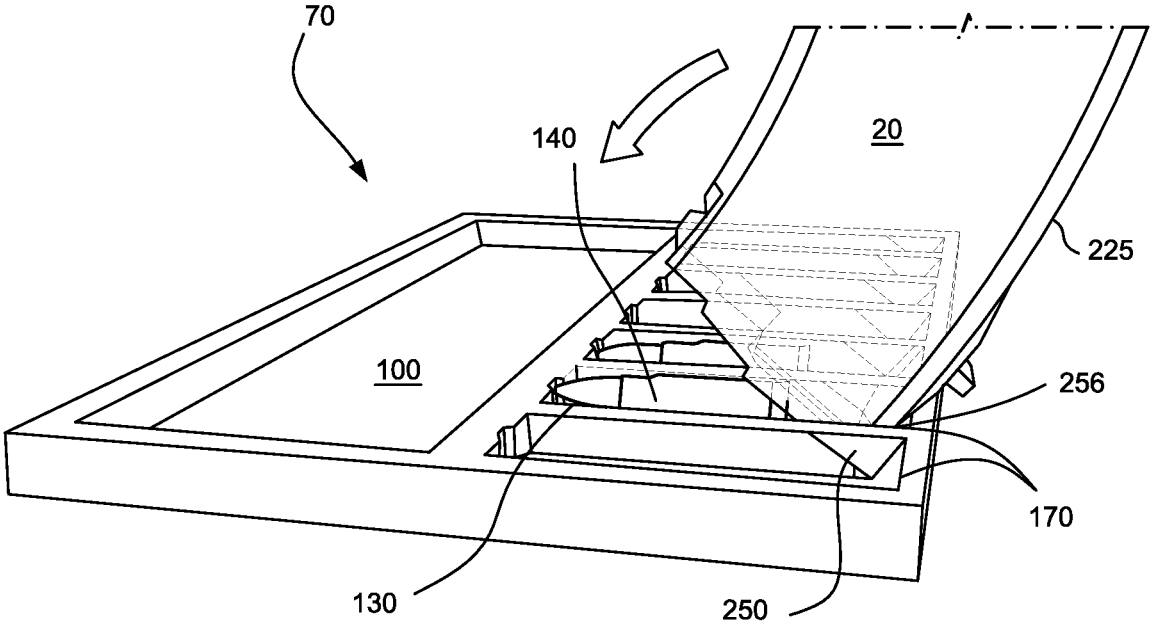
FIG. 12 shows the magazine being loaded with ammunition positioned in the magazine loading tray.

When the loading end 65 of the magazine 20 is received by the loading compartment 130, the forward portion of the loading end 65 (the portion with the wider opening) is positioned toward the front wall 180 of the loading compartment 130. In addition, the rear side 255 of the loading end 65 (the portion with the feed lips 250) is positioned against or adjacent to the rear wall 170 of the loading compartment 130. In addition, the magazine 20 is positioned at an angle relative to the floor 160 of the loading compartment 130 so that at least a portion of the feed lips 250 at the bottom rear edge 256 of the magazine 20 rests on the floor 160 and the forward portion of the loading end 65 with the wider opening is raised off of the floor 160 (see FIG. 12).

The rear wall 170 may act as a guide for the initial orientation of the magazine 20. In particular, resting the magazine 20 against the rear wall 170 may automatically orient the (or incline) the magazine 20 at the desired angle. Thus, the rear wall 170 may be inclined at the target inclination angle of the magazine 20. For loading compartments 130 that lack a rear wall 170, the magazine 20 may be oriented at the target angle without a guide.

When in the magazine 20 is in the initial insertion position (i.e., positioned against the rear wall 170 of the loading compartment 130 and inclined), the rear portion of the ammunition cartridge 140 will be under the forward portion of the loading end 65

After the magazine 20 has been placed in the initial position (step 510), the magazine 20 may be rotated (or pivoted or rocked) toward the front wall 180 of the loading compartment 130 with the pivot point being the bottom rear edge 256 of the loading end 65 of the magazine 20 (i.e., the edge of the magazine adjacent to the feed lips 250) (step 520). The initial position of the magazine 20 may be such that there is enough space between the ammunition cartridge 140 and the magazine 20 to allow the feed lips to engage the portion floor 160 that is unoccupied by the ammunition cartridge 140 after the magazine has been fully pivoted or rotated. Rotating the magazine 20 in this manner will cause the forward portion of the loading end 65 of the magazine 20 to engage a rear end 260 of the ammunition cartridge 140, thereby pressing the rear end 260 of the ammunition cartridge 140 into the wider opening of the loading end 65 of the magazine 20.

Once the magazine 20 has been fully rotated or fully pivoted so that the rear end 260 of the ammunition cartridge 140 has entered the loading end 65 of the magazine 20 and the magazine cannot be rotated or pivoted anymore (due to the ammunition cartridge 140 and or loading tray 70 preventing further rotational or pivoting movement of the magazine 20), the magazine 20 may be slid (or moved horizontally) toward the front wall 180 of the loading compartment 130 so that the rest of the ammunition cartridge 140 slides into the loading end 65 of the magazine 20 (step 530). The loading end 65 of the magazine 20 may be in constant contact with the shelves 200 during this step. In addition, the magazine 20 may be slid across the shelves 200 until the magazine 20 abuts the front wall 180 (FIG. 13).

As the magazine 20 is slid forward and the ammunition cartridge 140 is loaded into the magazine 20, the ammunition cartridge 140 may pivot or rotate so that the rear side of the ammunition cartridge 140 is higher than the front side of the ammunition cartridge 140.

Once the ammunition cartridge 140 has been fully loaded into the magazine 20, the loading process can be repeated if there are other ammunition cartridges 140 to be loaded into the magazine. Otherwise, the loading process can be terminated.

Figure 8B:
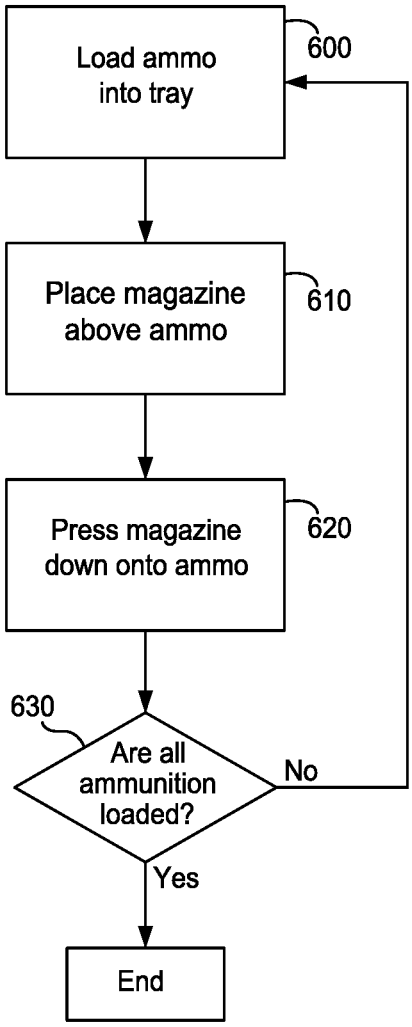
FIG. 8B is a flow diagram showing another method for loading a magazine.

FIG. 8B shows a flow diagram for another method of loading the ammunition cartridge 140 into the magazine 20. In the first step 600, the ammunition cartridges 140 are placed in the loading compartments 130. Not all of the loading compartments 130 need be loaded, and any number of loading compartments 130 may be loaded. When positioning the ammunition cartridge 140 into the loading compartment 130, the ammunition cartridge 140 may be positioned in the recess 190 and as far forward as possible so that a front tip of the ammunition cartridge 140 extends beyond the lateral portions 230 of the front wall 180. It is contemplated that the tip of the ammunition cartridge 140 may abut the offset portion 240 of the front wall 180. For configurations lacking a central offset portion 140, the ammunition cartridge merely abuts the front wall 180. The narrower width of the loading compartment 130 in the recess 190 and offset portion 240 helps stabilize the ammunition cartridge 140 and restricts lateral movement of the ammunition cartridge 140 during the loading process.

After the ammunition cartridges 140 have been loaded into the loading compartments 130, the loading end 65 of the magazine 20 may be positioned vertically above the ammunition cartridge 140 (step 610). The magazine 20 may then be lowered so that the ammunition cartridge 140 presses the ammunition cartridge 140 against the floor 160. This results in the ammunition cartridge 140 being pressed into the magazine 20 (step 620).

It should be noted that this method may be used with magazines 20 having resiliently flexible feed lips 250. When the magazine presses downward against the ammunition cartridge 140, the ammunition cartridge 140 may cause the feed lips 250 to flex inwardly, thereby enlarging the opening between the feed lips 250 and allowing the ammunition cartridge 140 to pass between the feed lips 250 and into the magazine 20. Once the ammunition cartridge 140 is full inserted into the magazine (i.e., the ammunition cartridge 140 have been fully inserted and is clear of the feed lips 250, the feed lips 250 may spring back to their original configuration.

Once the ammunition cartridge 140 has been fully loaded into the magazine 20, the loading process can be repeated if there are other ammunition cartridges 140 to be loaded into the magazine. Otherwise, the loading process can be terminated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An ammunition loading tray configured to hold an ammunition cartridge in a loading position, the ammunition loading tray comprising:

a loading compartment comprising a front side and an inclined rear wall that is opposite the front side and being configured to hold a corresponding ammunition cartridge in a loading position, the loading compartment comprising:

a magazine receiving portion configured to support an ammunition magazine from below and allow for less lateral movement of the ammunition magazine in a first direction than lateral movement of the ammunition magazine in a second direction that is perpendicular to the first direction; and an ammunition cartridge receiving portion located within the magazine receiving portion and including a recess in a floor of the magazine receiving portion, the ammunition cartridge receiving portion being configured to support the ammunition cartridge from below and limit lateral movement of the ammunition cartridge in the first direction while allowing lateral movement of the ammunition cartridge in the second direction, wherein a perimeter of the magazine receiving portion is larger than a perimeter of the ammunition cartridge receiving portion, and wherein the recess in the floor of the magazine receiving portion extends to the inclined rear wall of the loading compartment.

2. The ammunition loading tray of claim 1, wherein the loading compartment comprises a forward stop configured to limit forward movement of the ammunition magazine and the ammunition cartridge in the second direction.

3. The ammunition loading tray of claim 2, wherein the forward stop is in the form of a wall.

4. The ammunition loading tray of claim 1, wherein the loading compartment comprises a pair of opposing side walls extending from the front side of the loading compartment to the inclined rear wall of the loading compartment.

5. The ammunition loading tray of claim 1, wherein the loading compartment is one of a plurality of loading compartments.

6. The ammunition loading tray of claim 1, wherein the inclined rear wall is inclined in a rearward direction.

7. The ammunition loading tray of claim 1, wherein the loading compartment is sized to receive ammunition cartridges of different sizes.

8. The ammunition loading tray of claim 1, further comprising one or more storage compartments.

9. The ammunition loading tray of claim 8, wherein the one or more storage compartments are configured to hold one or more ammunition cartridges and/or a firearm magazine.

10. The ammunition loading tray of claim 1, wherein a length of the ammunition cartridge in the second direction is greater than or equal to or greater than a length of the magazine receiving portion in the second direction.

11. The ammunition loading tray of claim 1, wherein the magazine receiving portion comprises a floor that is sloped.

12. The ammunition loading tray of claim 11, wherein the floor of the magazine receiving portion is sloped toward or away from the ammunition cartridge receiving portion.

13. The ammunition loading tray of claim 1, wherein the ammunition cartridge receiving portion comprises a floor that is sloped toward a central portion of the ammunition cartridge receiving portion.

14. The ammunition loading tray of claim 1, wherein a width of the ammunition cartridge receiving portion in the first direction is less than a length of the ammunition cartridge receiving portion in the second direction.

15. The ammunition loading tray of claim 1, wherein a width of the magazine receiving portion in the first direction is less than a length of the magazine receiving portion in the second direction.

16. A firearm magazine loading system comprising:

the ammunition loading tray of claim 1; and a firearm magazine.

17. The firearm magazine loading system of claim 16, further comprising a firearm.

18. An ammunition loading tray configured to hold one or more ammunition cartridges in a loading position, the ammunition loading tray comprising:

one or more loading compartments, each loading compartment having an inclined rear wall and being configured to hold an ammunition cartridge in a loading position and comprising:

a supporting surface configured to support an ammunition magazine from below, the supporting surface being further configured to allow for less lateral movement of the ammunition magazine in a first direction while allowing lateral movement of the ammunition magazine in a second direction that is perpendicular to the first direction; and a recess in the supporting surface configured to support the ammunition cartridge from below and limit lateral movement of the ammunition cartridge in the first direction while allowing lateral movement of the ammunition cartridge in the second direction, wherein the recess in the supporting surface extends to the inclined rear wall.

19. An ammunition loading tray configured to hold one or more ammunition cartridges in a loading position, the ammunition loading tray comprising:

one or more loading recesses, each loading recess having an inclined rear wall and being configured to receive an ammunition magazine and allow for less lateral movement of the ammunition magazine in a first direction while allowing lateral movement of the ammunition magazine in a second direction that is perpendicular to the first direction; and an ammunition cartridge holder located within a respective one of the one or more loading recesses, the ammunition cartridge holder being open from above and being configured to support the ammunition cartridge from below, the ammunition cartridge holder being further configured to limit lateral movement of the ammunition cartridge in the first direction while allowing lateral movement of the ammunition cartridge in the second direction, wherein each ammunition cartridge holder comprises a recess that extends to the inclined rear wall of a respective one of the one or more loading recesses.

20. A method for loading a firearm magazine comprising:

positioning an ammunition cartridge into a corresponding loading compartment of the ammunition loading tray of claim 1;

positioning a loading end of an ammunition magazine against a floor of the loading compartment at an inclined orientation;

rotating or pivoting the ammunition magazine forward to press a portion of the ammunition cartridge into the ammunition magazine; and sliding the ammunition magazine forward so that the ammunition cartridge slides into the ammunition magazine.

21. The method of claim 20, wherein the ammunition loading tray holds the ammunition cartridge in a loading orientation so that when the ammunition magazine is slid forward, the ammunition magazine moves along a longitudinal axis of the ammunition cartridge.

22. The method of claim 20, wherein the ammunition cartridge pivots as the ammunition cartridge is loaded into the ammunition magazine.

23. The method of claim 20, wherein the ammunition magazine comprises a follower and a spring that biases the follower toward the loading end of the ammunition magazine.

24. The method of claim 20, wherein during the rotating or pivoting step, the ammunition magazine is pivoted around a lower rear edge of the ammunition magazine.

25. The method of claim 20, wherein the loading compartment limits lateral movement of the ammunition cartridge in a direction that is perpendicular to the sliding motion of the ammunition magazine and limits lateral movement of the ammunition magazine in the direction that is perpendicular to the sliding motion of the ammunition magazine.

26. The method of claim 20, wherein the ammunition magazine remains in contact with a floor of the loading compartment as the ammunition magazine is slid forward.

27. The method of claim 20, wherein the loading compartment limits the forward movement of the ammunition magazine so that a front tip of the ammunition cartridge is further forward than the furthest extent of the forward movement of the ammunition magazine when the ammunition cartridge is positioned in the loading compartment.

* * * * *